US008419595B1

(12) United States Patent
Hanswirth et al.

(10) Patent No.: US 8,419,595 B1
(45) Date of Patent: Apr. 16, 2013

(54) DENTAL APPLIANCE AND METHOD OF FITTING

(76) Inventors: David Hanswirth, White Plains, NJ (US); Lucia D. Banko, Armonk, NY (US)

( * ) Notice: Subject to any disclaimer, the term of this patent is extended or adjusted under 35 U.S.C. 154(b) by 88 days.

(21) Appl. No.: 12/857,471

(22) Filed: Aug. 16, 2010

(51) Int. Cl.
*A63B 23/03* (2006.01)

(52) U.S. Cl.
USPC ..... 482/11; 482/10

(58) Field of Classification Search ..... 482/10, 482/11, 148; 128/859, 860, 861, 862; 433/6, 433/34, 70, 71, 80; D24/181; D29/108
See application file for complete search history.

(56) References Cited

U.S. PATENT DOCUMENTS

| | | | | |
|---|---|---|---|---|
| 994,213 | A | 6/1911 | Supplee | |
| 1,226,382 | A | 5/1917 | Robertson | |
| 1,417,345 | A | 5/1922 | Pimienta | |
| 2,590,118 | A * | 3/1952 | Oddo, Jr. | 128/861 |
| 3,124,129 | A * | 3/1964 | Grossberg | 128/862 |
| 3,584,620 | A | 6/1971 | Hale | 128/76 |
| 4,580,980 | A | 4/1986 | Acquanetta | 433/176 |
| 5,592,951 | A * | 1/1997 | Castagnaro et al. | 128/848 |
| 6,584,978 | B1 | 7/2003 | Brett | 128/859 |
| 6,637,436 | B2 * | 10/2003 | Farrell | 128/861 |
| 6,945,778 | B2 | 9/2005 | Jacobs | 433/37 |
| 7,137,814 | B2 | 11/2006 | Fischer | 433/80 |
| 7,156,774 | B2 | 1/2007 | Mohindra | 482/11 |
| 7,328,706 | B2 | 2/2008 | Bardach | 128/861 |
| 7,416,516 | B2 * | 8/2008 | Mohindra | 482/11 |
| 7,658,193 | B2 * | 2/2010 | Lesniak | 128/862 |
| 7,798,149 | B2 * | 9/2010 | Haduong | 128/845 |
| 7,954,496 | B2 * | 6/2011 | Jansheski et al. | 128/859 |
| 8,100,131 | B2 * | 1/2012 | Swann et al. | 128/861 |
| 2005/0175963 | A1 | 8/2005 | Bruce | 433/140 |
| 2006/0172262 | A1 | 8/2006 | Bruce | 433/229 |
| 2010/0024833 | A1 | 2/2010 | Swann | 128/861 |
| 2010/0139670 | A1 * | 6/2010 | Lesniak | 128/862 |

* cited by examiner

*Primary Examiner* — Glenn Richman
(74) *Attorney, Agent, or Firm* — Leason Ellis LLP.

(57) ABSTRACT

An elastomeric dental appliance to reduce the effect of facial age lines has a U-shaped channel piece with a continuous bottom wall, walls extending from the bottom wall inner and outer edges, bite pads on the upper and lower surfaces of both legs of the channel piece, and a wing extending upwardly from the top edge of the outer wall of each channel piece leg to engage the inside of the lips in the areas of the naslobial fold lines and push them outwardly. During fitting the appliance is placed in a heated liquid to soften, the user protrudes the lower jaw by a distance of from 1-3 mm from the normal position and bites into the bite pads to make teeth impressions so that the appliance in use provides a vertical separation of about 3 mm between the opposing teeth occlusal surfaces with the jaw protruding forward.

20 Claims, 2 Drawing Sheets

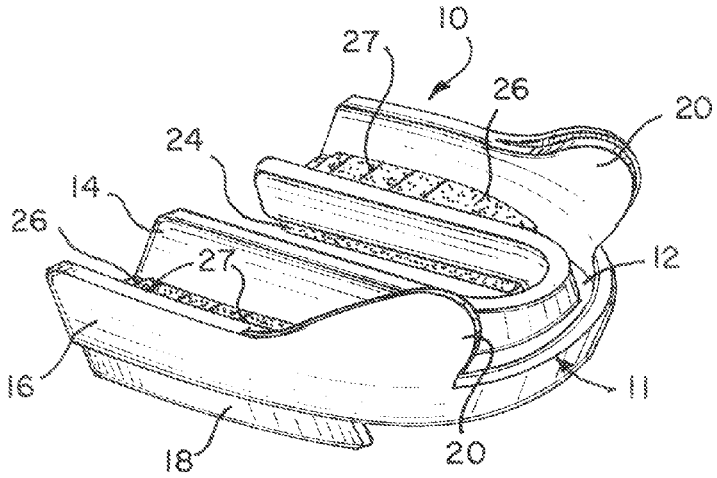
FIG. 1
FIG. 2
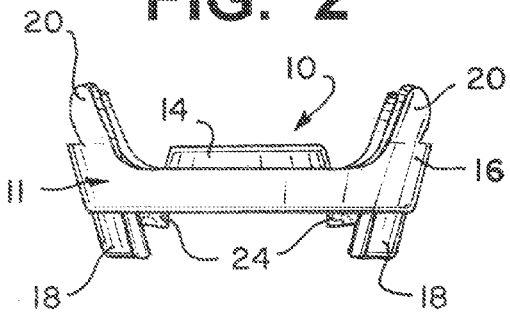
FIG. 3
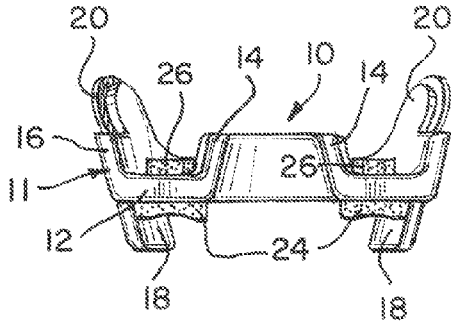
FIG. 4
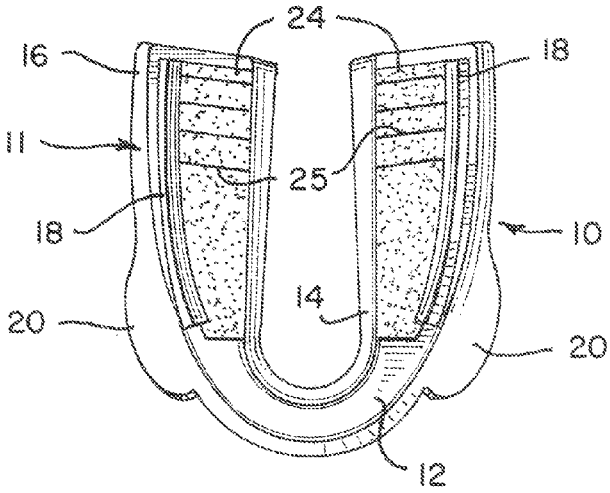

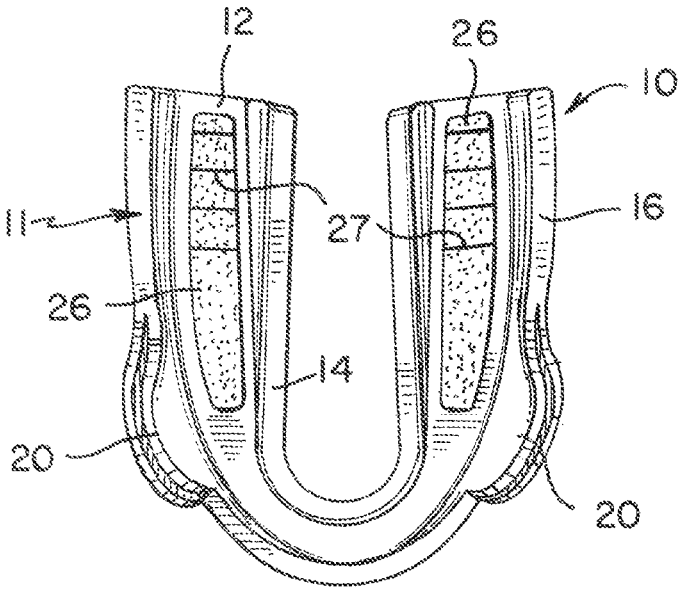
FIG. 5
FIG. 6
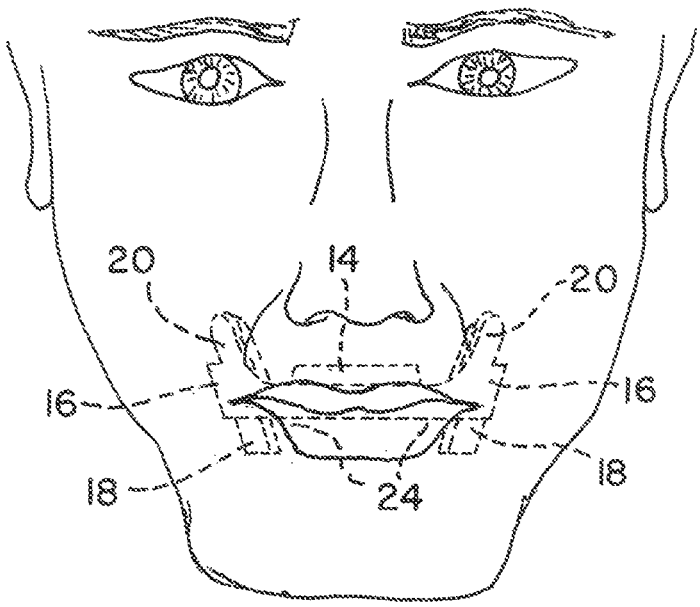

DENTAL APPLIANCE AND METHOD OF FITTING

FIELD OF THE INVENTION

The subject invention is a dental appliance used to support the muscles of the face and neck to reduce the appearance of facial aging and a method of fitting the appliance.

BACKGROUND OF THE INVENTION

As people age the facial muscles become less taut and sag. This causes the skin of the face to sag and give the appearance of facial aging. People with sagging facial muscles often maintain their jaws in an over-closed condition instead of in a normal rest posture. The normal rest posture is the jaw position in space, with the jaws relaxed and the teeth spaced apart so that the occlusal surfaces of the upper and lower teeth are not engaged. When the jaw is kept more tightly closed than when in the normal rest posture there is little vertical separation between the upper and lower teeth. In this over-closed condition the bones do not get stimulated because there are facial muscles that are not at their peak level of activity.

Various dental appliances that do not require surgical implantation exist that aim to reduce the appearance of aging in the face, mouth and neck areas. One such appliance, or prosthesis, believed to be known as the Angelift, is described in U.S. pre-grant publications, 2005/0175963, published Aug. 11, 2005 and 2006/0172262 published Aug. 3, 2006. This appliance is formed to fit around the upper or lower gum. The appliance has an upper and lower support in the anterior vestibule between the alveolar mucosa and the lip. The supports are intended to contact and push the facial skin around the mouth and jaw outward to reduce the appearance of wrinkles or aging lines. The thickness of the appliance can be varied to achieve a desired facial appearance. The appliance is attached to the teeth by wires.

Another such appliance is known as the Oralift, which appears to be the subject of U.S. Pat. No. 7,416,516. This is an appliance for reducing facial aging which is formed of an elastomeric material that can be fitted to the teeth so as to maintain a predetermined vertical separation of the jaws to reestablish the jaw rest posture at various vertical heights. When the jaws are in the resting posture there is a freeway space between the teeth. The freeway space is defined as the inter-occlusal distance or separation between the occlusal surfaces of the teeth when the mandible is in its physiologic rest position. When the jaws are relaxed in a normal rest posture, the freeway space is usually from about 2.5-3 mm. When the jaws are more tightly clenched, the freeway space is less.

U.S. Pat. No. 7,416,516 discloses an appliance that is to make the resting posture of the jaws to be at least 3 mm greater than normal. If the freeway space with the jaws relaxed in its rest position is from about 2.5-3.0 mm, the appliance of the patent would keep the teeth further separated and make the freeway space about 6 mm. In actual use of the Oralift appliance, and as disclosed in the patent, the additional separation from the normal jaw relaxed rest position is reported to be as much as 20 mm, which would make the freeway space even greater. The appliance of this patent does not have any way to push out selected areas of the face, particularly at the nasolabial folds of the face. The Oralift appliance is one that is often fitted by a dentist with special training and a technician is required to fabricate it.

In U.S. Pat. No. 4,580,980 a denture is disclosed for reducing the cosmetic effect of facial age lines. The denture, shown for the upper set of teeth, includes protuberances extending from what corresponds to the denture gum area to engage the inside of the cheek to stretch the overlying skin so as to urge age lines into a more youthful configuration. This appliance is useful only for people without normal teeth and requires special fitting.

Accordingly, it is desired to provide a dental appliance that does not have to be surgically implanted and can achieve the desired effect of reducing the appearance of aging in the face and that can be easily fitted to a user, even by the user himself.

BRIEF DESCRIPTION OF THE INVENTION

In accordance with the invention, an elastomeric dental appliance is provided that produces the desired results of achieving the appearance of a reduction in facial aging and that can be easily fitted to a user. The appliance also reduces the appearance of aging in the mouth and neck areas. The appliance of the invention reestablishes the jaw rest posture vertical separation to be such that facial muscles are made more taut. The appliance is constructed so that it also engages other parts of the face to improve appearance and to strengthen other parts of the facial structure. Further, it is fitted so that when used it protrudes the jaw forward to stretch the neck muscles.

The appliance is formed as a U-shaped piece of an elastomeric material of channel shape having a continuous bottom wall. Walls extend substantially vertically upward (toward the upper teeth) from each edge the upper side of the bottom wall. Bite pads are provided on both the upper and lower surfaces of the bottom wall of both legs of the U-shaped channel piece in which teeth depressions are made during fitting of the appliance by a user. Elliptical shaped wings extend from the edge of the upwardly extending outer vertical wall of both legs of the channel piece to engage the inside of the upper lip and support the nasolabial fold of the face. This provides lip support and increases Cupid's Bow. The curved central part of the U-shaped channel piece will engage the lower lip around the mouth opening. This stretches the obicularis oris muscle so as to re-establish the sarcomere length. Further, a flap extends downwardly from the posterior of each channel piece leg to overlie the lower teeth gums so as to engage the inside of the lower one third part of the face the and give support to the skin in this area of the face.

The appliance preferably is of an elastomeric material that is fitted to a user by using a boil and bite method in which the appliance is placed in hot water to soften so that its parts can be deformed when fitted in the mouth of a user. The appliance is then inserted into the user's mouth so that the channel piece, flaps and wings are conformed to the jaw, teeth and facial structure. The user closes his jaws for the teeth to bite into the bite pads and make impressions into which the teeth are to fit when the appliance is later being used. During fitting of the appliance when the teeth impressions are made in the bite pads, the jaw preferably is protruded forward from its normal position by a desired amount, typically 1-3 mm.

The appliance is constructed so that when it is used with the teeth in the bite pad impressions, a rest posture is established that has a freeway space between the teeth of about 3 mm. The re-established vertical distance of the rest posture will stretch the facial muscles and stimulate the obicularis oris. Also, when the appliance is in use, the protrusion of the jaw from its normal position set during fitting of the appliance gives support to the neck muscles and area under the chin. The jaw protrusion also increases support of the muscles around the cheekbones.

A user wearing the appliance will have the combined beneficial effects of the re-established vertical separation, jaw protrusion, engagement of the inner lips at the nasolobial fold lines by the appliance wings, and engagement of the lower face by the flaps that overlie the gums. All of these will contribute to reducing the appearance of the aging effect. As another advantage, the user of the appliance does not necessarily have to visit a dental office in order to have the appliance fitted and to learn how to use it.

BRIEF DESCRIPTION OF THE DRAWINGS

Other objects and advantages of the present invention will become more apparent upon reference to the following specification and annexed drawings in which:

FIG. 1 is a top perspective view of the appliance;

FIG. 2 is a front elevational view;

FIG. 3 is a rear elevational view;

FIG. 4 is a bottom plan view;

FIG. 5 is a top plan view; and

FIG. 6 is a drawing of the human face which shows the appliance in place and the lines of the mouth and face.

DETAILED DESCRIPTION OF THE INVENTION

FIGS. 1-5 show the appliance 10 which is to fit on the lower set of teeth. The appliance includes a generally U, or horseshoe, shaped channel piece 11 of an elastomeric material that has a curved central part from which two relatively straight legs extend. The U-shaped channel piece 11 has a continuous bottom wall 12. Also, a continuous inner wall 14 and a continuous outer wall 16 extend upwardly from the side edges of the bottom wall and are generally perpendicular to the bottom wall.

An elongated flap 18 extends downwardly from the lower surface of the bottom wall 12 along the straight part of each leg of the piece 11 below the upper outer wall 16. Each flap 18 extends for a distance slightly from the end of its respective leg of the piece 11 to a point where the curved central part of the channel piece starts. When the appliance is fitted, each flap 18 will extend over the outer surface of the lower teeth and somewhat over the gums. The flaps will engage the inside of the lower part, approximately the lower third, of the face and give support to the skin in this area of the face.

The mesiobuccal aspect of the top part of the appliance has a wing piece 20 that extends upwardly from the top edge of each leg of the channel piece outer wall 16. Each wing 20 starts from a point approximately at the transition of the curved central part of the U for a distance back along each leg. Each of the wings 20 has the general shape part of an ellipse and is to engage the inner upper lip of the user in the area of a nasolabial fold line that runs from the lower corner of each nostril to the corner of the lip. This will to support the upper lip and push it outwardly when the appliance is in place.

An elongated lower bite pad 24 is on the bottom surface of the bottom wall 12 of each leg of the U-shaped piece along most of its length and width. The lower bite pads 24 are preferably about 1 mm in height, to be adapted to the occlusal (biting) surfaces of the lower teeth. An elongated upper bite pad 26 is on the top surface of the bottom wall 12 of each channel piece leg. The upper bite pads 26 also are preferably about 1 mm in height and are to adapt to the upper lingual cusps biting surfaces of the upper teeth primarily on the central groove and lingual cusp area, thereby not having the appliance occlude on the upper buccal cusps. That is, the buccal (cheek aspect) cusps of the upper teeth ideally should not engage heavily with the appliance. This could keep the jaw retruded (closer to the spine), which is undesirable.

The posterior region of the bite pads 24 and 26 preferably have raised serrated markings 25 and 27 that extend across the widths of the pads. These markings can be 1 mm apart, or some other distance, and provide marking measurements to help users to shorten the appliance legs to fit to their back teeth. This can be done by cutting the appliance legs with a knife or similar tool.

The appliance 10 is made of any suitable thermoplastic material such as EVA (ethylene vinyl acetate) that is currently used in dental carriers or trays and sports mouth guards. The appliance is to be fitted, described in detail below, using a boil and bite technique. Here the appliance is immersed in boiling water for a number of seconds, then allowed to cool somewhat, then placed in the mouth and the user bites into the bite pads. Various parts of the appliance have different ductility so that they will be more compliant to deformation and shaping when the fitting takes place. In general, the channel piece 11 including the wings 20 have the least ductility (will be the hardest and least deformable after being immersed in the boiling water), the bite pads 24 and 26 the greatest ductility and the flaps 18 having a ductility intermediate of the other two. The basic plastic material is modified with other plastics to obtain the different ductilities.

Mouth guards are typically made from plastics materials such as an ethylene vinyl acetate copolymer (EVA). Additives to the EVA provide special properties for the mouth guard material, for example, a copolymer of ethylene. Examples of thermoplastic resins that can be used to form dental treatment trays include, but are not limited to, one or more of polyolefins, ethylene-vinyl acetate copolymer (EVA), ethylene-vinyl alcohol copolymer (EVAL), polycaprolactone (PCL), polyvinyl chloride (PVC), polyesters, polycarbonates, polyamides, polyurethanes, and polyesteramides. Examples of suitable polyolefins include, but are not limited to, polyethylene (PE), high density polyethylene (HDPE), low density polyethylene (LDPE), ultra low density polyethylene (ULDPE), and polypropylene (PP). These materials with the necessary additives to obtain the desired ductility for its various parts can be used to make the appliance of the invention.

The appliance 10 can be made by any suitable conventional molding or heat forming technique. It can be made by a molding technique, such as injection molding, in which the channel piece 11, flaps 18 and bite pads 24 and 26 are fully integrated. To do this, a multi-stage mold is used in which first the channel piece 11 and wings 20 are formed, then the flaps 18 and finally the bite pads 24 and 26. The appliance also can be fabricated by a vacuum-forming or pressure-forming process whereby the necessary laminar sheets of the appropriate EVA materials are heat adapted to a mold. The number and type of lamina used and the thickness at any point is determined by the shapes and sizes of the channel piece 11 and wings 20, flaps 18 and the bite pads 24 and 26. For example, the appliance can be fabricated using layers of the materials with different ductilities in a vacuum thermoforming device.

Typical dimensions for the various parts of the appliance 10 are as follows:

a. width of channel piece bottom wall 12 12 mm b. thickness of channel piece bottom wall 12 3 mm c. height of channel piece inner and outer walls 14 and 16 3-5 mm d. thickness of channel piece inner and outer walls 14 and 60 3 mm e. wings 20 5-12 mm wide (back to front), 7 mm high, and 5 mm thick f. bottom bite pads 24 8 mm wide, 30 mm long, 1 mm thick g. top bite pads 26 5 mm wide, 30 mm long, 1 mm thick h. width of appliance across the ends of the channel piece legs 55 mm i. overall length of appliance 48 mm j. the height of the appliance is 3 mm vertically from the lower surface of the channel piece bottom wall 12 to the top edges of the walls 14 and 16 is 7 mm.

The appliance is to be fitted with the lower teeth on the lower bite pads 24 and the upper teeth on the upper bite pads 26. The appliance preferably is fitted using the boil and bite technique. First, the lengths of the legs are trimmed to a size corresponding to the back teeth of the user's jaws. The appliance 10 is dipped into boiling water which causes the parts to soften to different degrees as discussed above. The appliance is then placed into the user's mouth. The channel piece 11 is shaped to the jaw, the flaps 18 will overlie the lower teeth and part of the lower gums, and the wings 20 will engage the inside of the upper lip. The user then bites into the upper and lower byte pads 24 and 26 to make impressions in which the upper and lower teeth will fit when the appliance is used. As the user bites into the bite pads 24 and 26 to make the impressions, he protrudes the lower jaw forward slightly from its normal position. The protrusion is about 1-3 mm, with 2 mm being preferred. Protrusion of the jaw should be practiced by the user prior to fitting. During the fitting the user should not protrude the jaw to an uncomfortable position.

After fitting, the appliance is allowed to cool and it will thereafter retain the shape configured during the fitting. The appliance can be used repeatedly simply by the user placing it in her/his mouth so that the lower teeth fit into the depressions made in the lower bite pads 24 during the fitting and then moving the upper teeth into the depressions made in the upper bite pads 26.

FIG. 6 shows the appliance 10 in place in the mouth. When a user is wearing the appliance both the bottom and top jaw teeth fit into the depressions in the bite pads to keep the jaw rest posture free space at about 3 mm. As noted above, the bottom wall 12 of the channel piece is 3 mm thick and the upper and lower bite pads each 1 mm thick. The user bite usually will be substantially into the entire thicknesses of the bite pads leaving about, or somewhat a bit more than, 3 mm. The 3 mm separation produces an increase of muscle tension that will strain the bones to give more support and create a more youthful appearance. A vertical re-establishment of 3 mm has been widely accepted by the dental community and is mentioned in dental textbooks. Maintaining the resting jaw position at 3 mm will cause an increase in muscle activity. Muscles will see an increase in circulation, oxygen content, ATP production, glucose and calcium. The user also is able to separate the teeth from the appliance by opening the jaws more. This will increase the free space and further stretch the facial muscles.

The appliance when in place in the mouth also will maintain the jaw protrusion used during the fitting. The protrusion will lightly tense the anterior belly of the digastric muscle. This will give support to the neck muscles and skin from below the chin point to the hyoid bone. This makes the muscles of the face and neck give more facial support without being overworked.

As shown, the wings 20 engage the cheek of the user in the area of the nasolabial fold lines running from the corner of the nostrils to the corners of the lips to support them and to push them outwardly when the appliance is in place. The curved central part of the U-shaped channel piece 11 engages the lower lip around the mouth opening. This stretches the obicularis oris muscle so as to re-establish the sarcomere length.

Is suggested that the appliance be worn for about two hours every other day for two months. Then, the user can wear the appliance for 2 hours every other day until the desired results are achieved or there is no further improvement.

Specific features of the invention are shown in one or more of the drawings for convenience only, as each feature may be combined with other features in accordance with the invention. Alternative embodiments will be recognized by those skilled in the art and are intended to be included within the scope of the claims. Accordingly, the above description should be construed as illustrating and not limiting the scope of the invention. All such obvious changes and modifications are within the patented scope of the appended claims.

We claim:

1. A dental appliance to fit between the upper and lower teeth of a user to reduce the effect of aging of the face comprising:

a generally U-shaped channel piece of an elastomeric material having a continuous bottom wall and inner and outer walls extending generally transversely from the inner and outer edges of said bottom wall;

bite pads of elastomeric material on the upper and lower surfaces of each of the legs of the channel piece into which the teeth of the user bite to make tooth impressions; and wherein when tooth impressions on said bite pads on said upper and lower surfaces are engaged by the upper and lower teeth the appliance holds the jaws of a user protruded forward from a normal position by an amount of at least about 1 mm.

2. The dental appliance as claimed in claim 1 further comprising an elongated flap that extends along each leg of the channel piece from the bottom surface of said channel piece along the outer edge of said bottom wall and a wing extending upwardly from the top edge of the outer wall of each channel piece leg near the beginning of the curved part of the U and being generally in the shape of part of an ellipse to engage and stimulate the inside of the upper lip of the user in the areas of the nasolabial fold lines.

3. The dental appliance as claimed in claim 1 where said bite pads on said channel piece upper surface are located to adapt to the biting surfaces of the upper teeth primarily on a central groove and lingual cusp area, thereby not having the appliance occlude on the upper teeth buccal cusps.

4. The dental appliance as claimed in claim 1 wherein said bite pads on said channel piece upper and lower surfaces are of a material that has greater ductility than the material of said channel piece.

5. The dental appliance as claimed in claim 2 wherein said bite pads on said channel piece upper and lower surfaces are of a material that has greater ductility than the material of both said channel piece and said flaps.

6. The dental appliance as claimed in claim 5 wherein said flaps are of a material that is more ductile than that of said channel piece and less ductile than that of said bite pads.

7. The dental appliance as claimed in claim 1 wherein when tooth impressions on said bite pads on said upper and lower surfaces are engaged by the upper and lower teeth the appliance provides a vertical separation of about 3 mm between the opposing occlusal teeth surfaces.

8. The dental appliance as claimed in claim 2 wherein when tooth impressions on said bite pads on said upper and lower surfaces are engaged by the upper and lower teeth the appliance provides a vertical separation of about 3 mm between the opposing occlusal teeth surfaces.

9. The dental appliance as claimed in claim 1 wherein when tooth impressions on said bite pads on said upper and lower surfaces are engaged by the upper and lower teeth the appliance holds the jaws of a user protruded forward from a normal position by an amount in the range of from about 1-3 mm.

10. The dental appliance as claimed in claim 9 wherein when tooth impressions on said bite pads on said upper and lower surfaces are engaged by the upper and lower teeth the appliance provides a vertical separation of about 3 mm between the opposing occlusal teeth surfaces.

11. A dental appliance to fit between the upper and lower teeth of a user to reduce the effect of aging of the face comprising:

a generally U-shaped channel piece of an elastomeric material having a continuous bottom wall and walls extending generally transversely from the inner and outer edges of said bottom wall;

bite pads of elastomeric material on the upper and lower surfaces of each of the legs of the channel piece into which the teeth of the user bite to make impressions; and wherein when tooth impressions on said bite pads on said upper and lower surfaces are engaged by the upper and lower teeth the appliance provides a vertical separation of about 3 mm between the opposing occlusal teeth surfaces and holds the jaws of a user protruded forward from a normal position by an amount in the range of from about 1-3 mm.

12. A method of fitting a dental appliance between the upper and lower teeth of a user to reduce the effect of aging of the face comprising the steps of:

providing a generally U-shaped channel piece of an elastomeric material having a continuous bottom wall and inner and outer walls extending generally transversely from the inner and outer edges of said bottom wall, bite pads of elastomeric material on the upper and lower surfaces of each of the legs of the channel piece;

heating the appliance to soften at least said bite pads;

causing the user to protrude the lower jaw forward by a distance of at least 1 mm from the normal position; and placing the appliance in the mouth of the user while the lower jaw is protruding and the user is biting into the bite pads to make impressions of the teeth.

13. The method as claimed in claim 12 wherein the user protrudes the lower jaw forward by a distance of from 1-3 mm, preferably 2 mm from the normal position during the time that the teeth impressions are made.

14. The method as claimed in claim 12 wherein said appliance further comprises an elongated flap that extends along each leg of the channel piece from the bottom surface of said channel piece along the outer edge of said bottom wall that fits over the outer surface of the gums when the appliance is in place; and a wing of elastomeric material extending upwardly from the top edge of the outer wall of each channel piece leg near the beginning of the curved part of the U and being generally in the shape of part of an ellipse to engage the inside of the lips of the user in the areas of the naslobial fold lines.

15. The method as claimed in claim 12 wherein said bite pads on said channel piece top surface are located to adapt to the biting surfaces of the upper teeth primarily on a central groove and lingual cusp area, thereby not having the appliance occlude on the upper teeth buccal cusps.

16. The method as claimed in claim 14 wherein said bite pads are of a material that has greater ductility than the material of said channel piece.

17. The method as claimed in claim 14 wherein said bite pads are of a material that has greater ductility than the material of both said channel piece and said flaps.

18. The method as claimed in claim 17 wherein said flaps are of a material that is more ductile than that of said channel piece and less ductile than that of said bite pads.

19. The method as claimed in claim 12 that when tooth impressions on said bite pads on said upper and lower surfaces are engaged by the upper and lower teeth the appliance provides a vertical separation of about 3 mm between the opposing occlusal teeth surfaces.

20. The method as claimed in claim 14 that when tooth impressions on said bite pads on said upper and lower surfaces are engaged by the upper and lower teeth the appliance provides a vertical separation of about 3 mm between the opposing occlusal teeth surfaces.

* * * * *